United States Patent [19]

Matsumoto et al.

[11] 3,996,404

[45] Dec. 7, 1976

[54] CONJUGATE POLYCARBONATE FIBERS AND FIBROUS SHEETS MADE THEREOF

[75] Inventors: Kounosuke Matsumoto; Tadashi Tamura; Akira Morita; Sigeru Imayasu, all of Moriyama; Toshio Nomura, Shiga, all of Japan

[73] Assignee: Japan Vilene Company Ltd., Toyko, Japan

[22] Filed: July 28, 1975

[21] Appl. No.: 599,327

[30] Foreign Application Priority Data

| | | |
|---|---|---|
| July 30, 1974 | Japan | 49-86634 |
| Mar. 20, 1975 | Japan | 50-33025 |
| May 29, 1975 | Japan | 50-63512 |

[52] U.S. Cl. ..... 428/224; 156/181; 156/296; 156/305; 174/110 SR; 428/373; 428/374; 428/412

[51] Int. Cl.[2] ..... D02G 3/00; D04H 1/54

[58] Field of Search ..... 156/181, 180, 296, 305, 156/307, 53, 83–85, 155; 428/296, 365, 297, 370, 373, 374, 412, 224; 174/25 R, 110 SR, 100 C, 100 FP, 121 R, 121 SR; 264/DIG. 26, 171, 174

[56] References Cited

UNITED STATES PATENTS

| | | | |
|---|---|---|---|
| 3,063,454 | 11/1962 | Coates et al. | 156/305 |
| 3,429,983 | 2/1969 | Hofmeier | 156/53 |
| 3,516,239 | 1/1970 | Fukuda et al. | 428/412 |
| 3,562,374 | 2/1971 | Okamoto et al. | 264/174 |
| 3,567,548 | 3/1971 | Miller | 156/72 |
| 3,645,819 | 2/1972 | Fujii et al. | 156/296 |
| 3,706,613 | 12/1972 | Masamichitoki et al. | 156/296 |
| 3,716,614 | 2/1973 | Okamoto et al. | 156/296 |
| 3,775,549 | 11/1973 | Matsuda et al. | 174/120 FP |
| 3,830,683 | 8/1974 | Bohrn | 8/130.1 |
| 3,914,501 | 10/1975 | Miller et al. | 428/297 |

*Primary Examiner*—William A. Powell
*Assistant Examiner*—Michael W. Ball
*Attorney, Agent, or Firm*—Woodhams, Blanchard and Flynn

[57] ABSTRACT

A conjugate polycarbonate fiber comprising 95% to 50% by weight of a polycarbonate component and 5 to 50% by weight of a polypropylene component wherein ultrafine fibers composed of the polypropylene component are dispersed and arranged in a bundle-like form in the polycarbonate component as the fiber matrix, whereby the crazing resistance and oil resistance are improved. The conjugate polycarbonate fiber can be made into fibrous sheets and non-woven fabrics. The non-woven fabrics are adapted to be used as insulating layers in electric power cables.

9 Claims, 10 Drawing Figures

CONJUGATE POLYCARBONATE FIBERS AND FIBROUS SHEETS MADE THEREOF

BACKGROUND OF THE INVENTION

1. Field of the Invention

This invention relates to conjugate polycarbonate fibers and fibrous sheets composed of such polycarbonate fibers. Further, the invention relates to non-woven fabrics made of conjugate polycarbonate fibers which fabrics can be very effectively used as electric insulating materials for various OF cables for ultra high voltages, or capacitors, because they do not undergo any change of form, such as swelling, dissolution and crazing when in contact with insulating oils such as mineral oils and synthetic oils and they have a compact structure characterized by a Gurley porosity of at least 500 seconds per 100 cc.

The term polycarbonate used in this invention means a linear polymer containing carbonic acid ester linkages $$(-O-\underset{\underset{O}{\|}}{C}-O-)$$

recurring periodically in the molecule. These polycarbonates are known substances, per se. They can be synthesized by, for example, the phosgene method in which phosgene is introduced into a 4,4′-dihydroxydiaryl alkane, such as bisphenol A, in the presence of an aqueous solution of an alkali and a solvent, or the ester exchange method in which the 4,4′-dihydroxydiaryl alkane is reacted with a diester of carbonic acid at a high temperature under a reduced pressure.

In the instant specification, the expression "a Gurley porosity of at least 500 seconds per 100 cc" is used for indicating the compactness of the structure. This expression means that the sample has an air permeability of at least 500 seconds per 100 cc as measured according to the method of JIS P-8117 for testing the air permeability of papers and cards using a tester of the B type (Gurley's densometer).

2. Description of the Prior Art

Polycarbonate resins have heretofore been used in the form of films as insulating materials for electric equipment such as condensers and transformers because they possess excellent heat resistance and dielectric characteristics, and they also are suitable as electric insulating materials. Polycarbonate resin films are advantageous in that the dielectric loss is small, but they are defective in that their oil immersion is very poor because of their smooth surface, and that their dielectric strength abruptly decreases with an increase of the thickness.

According to this invention, these defects of polycarbonate films are overcome by preparing polycarbonate fibers from polycarbonate resins and forming the fibers into fibrous sheets such as non-woven fabrics, papers and woven fabrics. When such fibrous sheet is used as an insulating material of an OF cable for 500 KV or 750 KV, the sheet should have a dielectric strength (impulse breakdown strength) of at least 120 KV/mm. For this purpose, the fibrous sheet should have a compact structure and in view of the oil immersion the fibrous sheet sould have a porous structure preferably a non-woven fibrous sheet structure. In short, the fibrous sheet should be a compact non-woven fabric having a uniform fine porous structure characterized by a Gurley porosity of at least 500 seconds per 100 cc.

More specifically, if the Gurley porosity is lower than 500 seconds per 100 cc, the fibrous sheet cannot be used because of its poor dielectric strength, and if the fibrous sheet does not have a fine porous structure like film it cannot be used because of a poor oil immersion. Therefore it was found that a non-woven fabric having a Gurley porosity of 500–50,000 seconds per 100 cc is required for this purpose.

SUMMARY OF THE INVENTION

It is therefore a primary object of this invention to provide polycarbonate fibers, fibrous sheets of polycarbonate fibers and non-woven fabrics of polycarbonate fibers having a uniform fine porous structure characterized by a Gurley porosity of at least 500 seconds per 100 cc, more especially 500–50,000 seconds per 100 cc.

Polycarbonate fibers are fatally defective in that they often become locally and drastically brittle when immersed in an insulating oil or under stress. Accordingly, fibrous sheets composed of polycarbonate fibers cannot be put into practical use, and none of the previous attempts to obtain electric insulating materials composed of fibrous sheets of polycarbonate fibers, such as papers, non-woven fabrics or woven fabrics were successful.

We have discovered that the phenomenon of brittleness in polycarbonate fibers is owing to the crazing phenomenon that occurs in a so-called amorphous polymer and that the brittleness in polycarbonate fibers can be effectively prevented by preventing occurrence of this crazing phenomenon. Based on this finding, we have now completed this invention.

In accordance with this invention, there are provided a conjugate polycarbonate fiber comprising 95 to 50% by weight of a polycarbonate component and 5 to 50% by weight of a polypropylene component wherein ultrafine fibers composed of the polypropylene component are dispersed and arranged in a bundle-like form in the polycarbonate component as the fiber matrix, whereby the crazing resistance and oil resistance are improved, a fibrous sheet composed of this fiber, and a non-woven fabric composed of this fiber and having a uniform fine porous structure characterized by a Gurley porosity of at least 500 seconds per 100 cc.

BRIEF DESCRIPTION OF THE DRAWINGS

As pointed out hereinabove, polycarbonate fibers become locally and drastically brittle under stress or in an insulating oil, with the passage of time. FIG. 1 is an optical microscope photograph showing the crazing phenomenon that occurs when a polycarbonate fiber is immersed in a dodecylbenzene insulating oil under a stress applied in the direction of the fiber axis. From FIG. 1, it will readily be understood that a great number of minute crazes or cracks that reflect light well are formed and they extend in a direction perpendicular to the direction of the stress, i.e., perpendicular to the diredtion of the fiber axis.

The physical property of the polycarbonate fiber is changed from its "as spun" ductility to brittleness by generation and development (further growth) of such crazes, and if an additional stress is further applied, the fiber is readily broken, and when it is used as an electric insulating material, a dielectric breakdown is readily caused to occur under an electric shock.

This crazing phenomenon in polycarbonate fibers refers to the phenomenon such that when an additional stress is applied, for example, by a load or a solvent, the stress acts in a concentrated fashion on localized areas of the amorphous portions of the fiber-forming polymer, especially on the amorphous portion having physical and chemical structural defects, and the polymer undergoes viscous flow at such amorphous portions to cause orientation of the polymer in the direction of the stress and this orientation of the polymer in the stress direction is successively propagated to adjoining portions. In short, orientation (crazing) of the polymer that occurs at a part of the fiber is developed or undergoes further growth in the direction of the fiber cross-section whereby the fiber is made drastically brittle in localized zones.

In general, crazing of a polymer is caused by concentration of a stress on physical and chemical structural defects, such as the order-disorder interface, molecular chain ends and heterogeneous portions (dust particles, scars, bubbles or the like). In polycarbonate fibers, it is considered that crazing is generated by the same cause.

Accordingly, a fundamental solution of the problem of preventing crazing in polycarbonate fibers is to remove structurally defective portions in fibers such as those mentioned above. However, it is substantially impossible to remove these defective portions completely in industrial production.

While we were studying the mechanism whereby polycarbonate fibers become brittle, we found that because brittleness is caused by both the generation of crazing and the further development thereof, even if the generation of crazing is not prevented, the polycarbonate fibers can be prevented from becoming brittle only by preventing the further development or extension of the crazing. In short, according to this invention, crazing (orientation) generated in the polycarbonate component is interrupted by another (second) component which is uniformly dispersed and arranged in the fiber to prevent development of crazing and in turn to prevent the polycarbonate fiber from becoming brittle.

It was considered that better results would be obtained when said other component that interrupts the development or growth of crazing could be dispersed and arranged in the polycarbonate component. Accordingly, a polyester, which has a good compatibility with the polycarbonate and has a melting point approximating that of the polycarbonate and has heretofore been used as an electric insulating material, was first chosen as said other (second) component.

Figure 2:
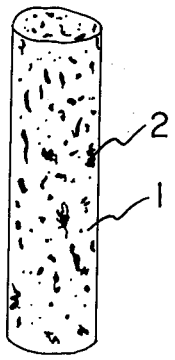
FIG. 2 is a schematic view illustrating a blend-spun fiber of a polycarbonate and a polyethylene terephthalate as described in Comparative Example 3, in which reference numberals 1 and 2 denote the polycarbonate component and the polyethylene terephthalate component, respectively.

A fiber obtained by incorporating a polyester resin in the pelletized state into a polycarbonate resin, melt-mixing them uniformly and melt-spinning the molten mixture (as described in detail in Comparative Example 3 given hereinafter) has a structure as shown in FIG. 2. Because of its good compatibility with the polycarbonate component, the polyester component is homogeneously blended and dispersed in the polycarbonate component and it does not have an independent identifiable fibrous structure. It was found that development of crazing could not be prevented in such polycarbonate fibers. In other words, development of crazing cannot be prevented unless said other (second) component is dispersed and arranged while retaining an organized, more or less bundle-like ultra-fine fibrous structure.

We discovered that polypropylene is effective as a resin capable of being melt-spun together with polycarbonate, but it is incapable of forming a uniform dispersed, more or less homogeneous non-fibrous state as shown in FIG. 2 because of its low compatibility with polycarbonate. In general polypropylene is rarely used as an electric insulating material because the polymer is readily swollen in an oil such as dodecylbenzene and mineral oil and it has a poor dimension stability. In this invention, however, polypropylene having a low oil resistance is especially chosen as the component for interrupting development of crazing in polycarbonate fibers.

Figure 3:
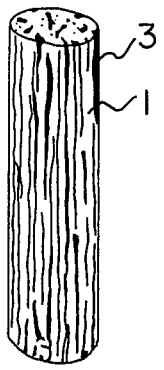
FIG. 3 is a schematic view of a conjugate polycarbonate fiber according to this invention, in which reference numeral 1 denotes the polycarbonate component and reference number 3 denote the polypropylene component.

A fiber obtained by melt-mixing a polypropylene resin in the pelletized state uniformly with a polycarbonate resin and melt-spinning the molten mixture has a structure as shown in FIG. 3. As is seen from FIG. 3, because of its poor compatibility, the polypropylene component takes a bundle-like form of ultrafine fibers and in this state it is dispersed and arranged in the polycarbonate component constituting the fiber matrix. Development of crazing in polycarbonate fibers cannot be prevented without the provision of such a specific structure.

The term "bundle-like form" or "bundle-like structure" means that the polypropylene component is present in the form of multiple independent, ultra-fine layers or filaments which are randomly dispersed in, extend subtantially lengthwide in and are embedded within a matrix or continuous phase of the polycarbonate component. In cross-section, the filament has the appearance of a large number of various sized islands of the polypropylene component scattered in an ocean of the polycarbonate component. The cross-section of the polypropylene islands, per se, can vary substantially, but all of them are very small in comparison with the total cross-sectional area of the filament. The above-mentioned "islands in an ocean" configuration appears only in the cross-section of the filament. The polycarbonate component is continuous in the longitudinal direction of the filament. The polypropylene layers or fibers also have a substantial length in the lengthwise direction of the filament, that is, the polypropylene layers or fibers on the average have a length of at least several centimeters, although individual layers or fibers can be longer or shorter than that. The polypropylene layers or fibers extend substantially lengthwise and generally in parallel to each other in the filament.

Portions of the periphery of the filament are occupied by the polypropylene ultra-fine filaments and the remainder of the periphery of the filaments are occupied by the polycarbonate.

However, no substantial effect can be obtained if the amount of the polypropylene component is smaller than 5% by weight, and if the amount of the polypropylene component exceeds 50% by weight, the dimensional stability of the resulting fiber is reduced because of the swelling of the polypropylene component. The dimensional stability can be kept at a high level by the matrix of the polycarbonate component, provided that the amount of the polypropylene component does not exceed 50% by weight. Especially when the amount of the polypropylene component is 10 to 30% by weight, brittleness of the fiber caused by crazing is prevented very effectively and the dimensional stability is highly improved.

Ultrafine fibers of the polypropylene component which are dispersed substantially uniformly and arranged in the bundle-like form have an effect of interrupting propagation of crazing (orientation) caused in the polycarbonate component. To our great surprise, it was also found that such ultrafine fibers have an effect of preventing any generation of crazing (orientation) itself when the stress is relatively small. It is considered that this effect is owing to the fact that the polypropylene component disperses the stress in the fiber and localized high concentration of the stress does not occur.

Accordingly, the fiber according to this invention is a fiber consisting essentially of 95 to 50% by weight a polycarbonate component and 5 direction to 50% by weight of a polypropylene component. By virtue of the feature that the ultrafine fibers of the polypropylene component are dispersed and arranged in the bundle-like form in the polycarbonate component constituting the fiber matrix, the conjugate polycarbonate fiber of this invention is provided with a very excellent crazing resistance and a very high oil resistance. Accordingly, a fibrous sheet prepared from this fiber, for example, a paper, non-woven fabric or woven fabric made of this fiber, is characterized in that none of such structural form changes as swelling, dissolution and crazing occur even when the fibrous sheet is immersed in an insulating oil, and therefore, such fibrous sheet can be used very suitably as an electric insulating material. Especially, a non-woven fabric prepared from such conjugate polycarbonate fiber according to a conventional technique overcomes all the defects of polycarbonate films, and it can be used very effectively as an electric insulating material not only for capacitors and transformers but also for power cables.

A compact non-woven fabric composed of this conjugate polycarbonate fiber and having a uniform fine porous structure characterized by a Gurley porosity of at least 500 seconds per 100 cc is especially suitable as an electric insulating material for OF cables for ultra high voltages and capacitors or the like because such form changes as swelling, dissolution and crazing are not caused even in an insulating oil.

This invention also provides a process for preparing a non-woven fabric having a uniform fine porous structure characterized by a Gurley porosity of at least 500 seconds per 100 cc, from this modified polycarbonate fiber.

As one method for preparing non-woven fabrics, there has heretofore been known a fiber-bonding method in which fibers are bonded together by utilizng heat, pressure or a solvent singly or in combination. A method utilizing the actions of heat, pressure and a solvent in combination for preparing a compact non-woven fabric is known in principle in the art.

This known method, however, provides only a product having a Gurley porosity of about 200 seconds per 100 cc at the highest. If it is intended to obtain a product having a more compact structure according to this known method, the resulting product has a film form. According to this known method, it is impossible to obtain a non-woven fabric having a desired uniform fine porous structure characterized by a Gurley porosity of a least 500 seconds per 100 cc. The reason is that the conditions required for forming a uniform fine porous structure cannot be controlled by the known method in which heat, pressure and a solvent are utilized in combination.

We have discovered a process for preparing compact non-woven fabrics of polycarbonate fibers in which the conditions for forming a uniform fine porous structure can easily be controlled.

More specifically, in accordance with this invention, there is also provided a process for preparing compact non-woven fabrics having a uniform fine porous structure, which comprises impregnating (1) a web of conjugate polycarbonate fibers having an average fiber diameter of less than 15 $\mu$ and comprising 95 to 50% by weight of a matrix of a polycarbonate component and 5 to 50% by weight of a polypropylene component dispersed and arranged in the form of bundles of ultrafine fibers in the polycarbonate component matrix, with (2) a liquid mixture which is inactive at room temperature. The liquid mixture (2) comprises (a) 5 to 90% by weight of a solvent for at least one component of the conjugate fiber and (b) 95 to 10% by weight of a non-solvent for both the components of the conjugate fiber, which is miscible with said solvent (a) and has a boiling point higher than that of said solvent (a), and press-bonding the impregnated web under heating to bond the fibers in the web together.

According to this invention, it is possible to produce a non-woven fabric of conjugate polycarbonate fibers having a uniform fine porous structure, by using a specific solvent and a specific non-solvent in combination and by employing a specific maximum average fiber diameter.

It is critical that the conjugated polycarbonate fibers used in this process to obtain a compact non-woven porous fabric should have an average fiber diameter of less than 15 $\mu$. If the average fiber diameter is larger than 15 $\mu$, the number of fibers per unit weight is reduced and a good uniformity cannot be attained. Further, if a web composed of thicker fibers is impregnated with a liquid mixture of a solvent and a non-solvent which is inactive at room temperature and the web is then press-bonded under heating, a sufficient deformation cannot be obtained in the fibers and a compact non-woven fabric is not obtained. However it is not practical to use the fibers having an average fiber diameter of less than 0.5 $\mu$.

A web is formed from the conjugate polycarbonate fibers having an average fiber diameter of 0.5 to 15 $\mu$. The form of the fiber is not critical and short-cut fibers, staple fibers, long or endless filaments and the like can be used in this invention. Further, any of the known methods such as the air-laying method, the carding method and the wet laying method, can be employed for forming webs of the conjugate polycarbonate fibers.

In general, it is preferred that the webs be formed by the so-called spun-bonded method, comprising incorporating the polypropylene resin in the pelletized state into a polycarbonate resin, melt-mixing them uniformly, melt spinning the molten mixture; and depositing the spun filaments immediately on a screen. The unit weight of the web can be optionally chosen, but the effects of this invention are manifested most conspicuously when the unit weight of the web is within range of from 50 to 150 g/m$^2$.

The thus-obtained web is then impregnated with a liquid mixture which is inactive at room temperature and which comprises (a) 5 to 90% by weight of a solvent for at least one component of the conjugate polypropylene-polycarbonate fiber and (b) 95 to 10% by weight of a non-solvent for both components of the conjugate fiber, which non-solvent (b) is miscible with said solvent (a) and has a boiling point higher than that of said solvent (a). The non-solvent (b) is incorporated as one component of the liquid mixture for controlling the activity of the solvent. The boiling point of the non-solvent, its compatibility with the solvent and amount thereof incorporated in the liquid mixture are of great significance.

If the boiling point of the solvent is higher than that of the non-solvent, the non-solvent evaporates first under heating to increase the solvent concentration, and hence, control of the activity of the solvent becomes impossible.

In the process of this invention, because the boiling point of the non-solvent is higher than that of the solvent, when the web is impregnated with the liquid mixture which is inactive at room temperature and is then press-bonded under heating, the solvent in the liquid mixture is activated to swell at least one component of the conjugate polycarbonate fiber, but since the concentration of the solvent is not increased during the press-bonding step, extreme swelling or dissolution that would cause the fiber to lose its form can be controlled and prevented. Further, the presence of the non-solvent during the press-bonding under heating promotes formation of fine pores while leaving a number of fine voids formed among the fibers in the web, and exhibits an effect of deforming and fixing the fibers without converting the fibrous web into a film form. It is preferred that the boiling point of the non-solvent be higher by at least 10° C than the boiling point of the solvent, but even if the boiling point of the non-solvent is higher than the boiling point of the solvent by less than 10° C, good results can be similarly obtained if conditions for the press-bonding under heating are carefully chosen and controlled.

It is also critical that the non-solvent should be miscible with the solvent. If a non-solvent having a poor compatibility with the solvent is employed, phase separation occurs in the liquid mixture, and hence, the web is not uniformly impregnated and uniform control of the activity of the solvent becomes impossible.

The mixing ratio of the non-solvent and the solvent should be such that the solvent comprises 5 to 90% by weight of the liquid mixture and the non-solvent is the balance, i.e. from 95 to 10% by weight. In other words, it is critical that the solvent is diluted with the non-solvent so that its concentration is from 5 to 90% by weight. If the solvent concentration is lower than 5% by weight, a sufficient activity of the solvent cannot be obtained, and if the solvent concentration is higher than 90% by weight, the activity of the solvent cannot be controlled.

Further, it is critical that this liquid mixture of the solvent and the non-solvent should be inactive, namely, incapable of swelling or dissolving the conjugate polycarbonate fiber, at room temperature (18°–25° C). If the activity of the solvent is not inhibited during the period beginning with completion of the impregnation with the liquid mixture until initiation of the press-bonding under heating, it is impossible for the solvent to manifest a uniform controlled activity in the web.

Preferred combinations of such solvent and non-solvent are listed in Table 1.

TABLE 1

Liquid Mixture

| Solvent | Non-Solvent |
|---|---|
| tetrahydrofuran | water |
| methylene chloride | methanol |
| tetrachloroethane | cellosolve acetate |
| trichloroethylene | n-heptane |

Further, a so-called mixed solvent comprising at least two solvents and a so-called mixed non-solvent comprising at least two non-solvents, can also be used as the solvent component and non-solvent component in this invention, provided that they satisfy the above-mentioned reqirements.

The web is impregnated with the liquid mixture by conventional procedures such as the spraying method and the dipping method. It is preferred that the web be subjected to a preliminary pressing treatment prior to the impregnation step, because the impregnation is facilitated by this pre-treatment. The amount impregnated of the liquid mixture is optionally determined depending on the desired degree of compactness in the resulting non-woven fabric, but in general, it is preferred that the amount impregnated of the liquid mixture be from 10 to 500% by weight, based on the weight of the web.

Any excess of the liquid mixture is removed from the liquid mixture-impregnated web by suction or compression so as to obtain a web impregnated with a desired amount of the liquid mixture. Then, the web is press-bonded under heating. This press-bonding under heating is generally performed by means of a calendar, and better results are generally obtained when a linear calendering pressure of 30 to 300 Kg/cm is applied. The temperature is selected depending on the pressure, and the press-bonding is generally conducted at a temperature of 120° to 160° C. If the temperature is too high, the fibers shrink, and a uniform sheet cannot be obtained.

By operating under the above conditions, a compact non-woven fabric having a uniform fine porous structure characterized by a Gurley porosity of at least 500 seconds per 100 cc can be obtained. In this invention, the degree of compactness can be increased to a Gurley porosity of 10,000 to 20,000 seconds per 100 cc, and if desired 50,000 seconds per 100 cc, by appropriately controlling such conditions as the ratio of the solvent in the liquid mixture, the temperature during the press-bonding step, the fiber diameter and the proportion of the polypropylene component dispersed and arranged in the conjugate polycarbonate fiber within the above-mentioned ranges, and by further adjusting such conditions as the unit weight of the web and the pressure during the press-bonding step.

A compact non-woven fabric of this invention, which has been prepared by the above-mentioned process steps and which is composed of a multitude of conjugated polycarbonate fibers having an average fiber diameter of from 0.5 to 15 $\mu$, comprising 95 to 50% by weight of a matrix of a polycarbonate component and 5 to 50% by weight of a polypropylene component dispersed and arranged in the polycarbonate component matrix in the form of bundles of ultrafine fibers, and having a uniform fine porous structure characterized by a Gurley porosity of at least 500 seconds per 100 cc, exhibits a good oil immersion property and does not undergo such form changes as swelling, dissolution and crazing when in contact with an insulating oil. Further, this compact non-woven fabric has a very high dielectric strength. Accordingly, it can be used very suitably and effectively as an electric insulating material for OF cables for ultra high voltages, transformers, condensers and the like.

This invention has been described mainly by reference to electric insulating materials intended to be immersed in insulating oils, but because of their excellent physical properties, for example, their excellent oil resistance, the polycarbonate fiber, fibrous sheet and non-woven fabric of this invention can be used effectively in various fields as other industrial materials.

This invention will now be further described in detail by reference to the following illustrative Examples that by no means limit the scope of this invention.

EXAMPLE 1

90% by weight of poly(4,4'-dihydroxydiphenyl-2,2-propane carbonate) as the polycarbonate and 10% by weight of polypropylene were mixed in the pelletized state to form a homogeneous mixture. The mixture was fed to an extruder and was extruded under conditions of a polymer flow rate of 10 g/min and a temperature of 280° C through 50 orifices, each having a diameter of 0.3 mm, and the extrudate was wound at a take-up rate of 150 m/min to obtain multifilaments, each filament having a diameter of about 50 $\mu$.

Figure 4:
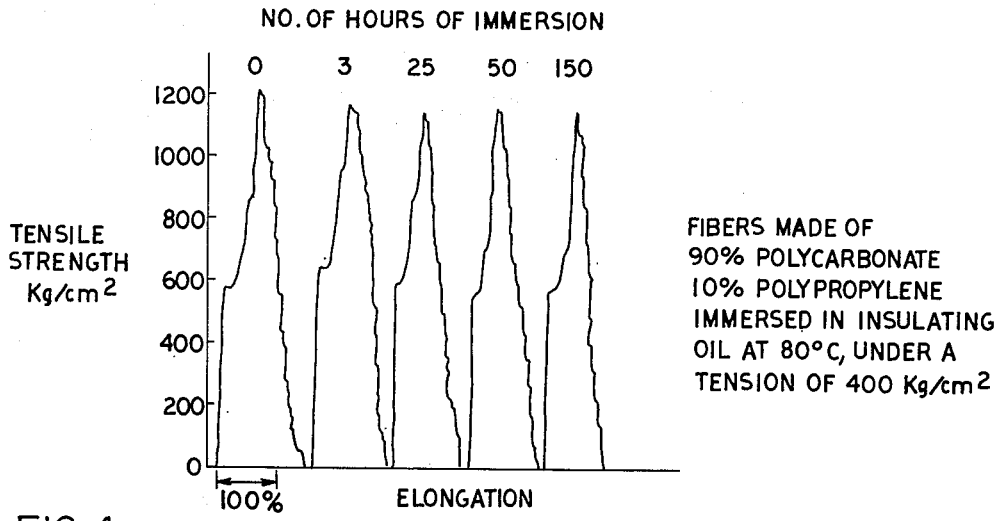
FIGS. 4 to 9 are graphs showing the relationship between the tensile strength and elongation in the fibers described in Examples 1 to 3 and Comparative Examples 1 to 3.

In order to perform an accelerated test for generation of crazing, the resulting multifilaments were wound on a glass tube (having an outer diameter of 2.43 cm) under a tension of 400 Kg/cm$^2$ and they were immersed in a dodecylbenzene insulating oil maintained at 80° C in this tension-applied state. Five specimens were prepared and they were taken out of the oil after passage of 0 hour, 3 hours, 25 hours, 50 hours and 150 hours, respectively. The tensile strength and elongation of each specimen were measured. The results obtained are shown in FIG. 4, from which it will readily be understood that the phenomenon of the polycarbonate fiber becoming brittle could be completely prevented. From observations under an optical microscope, it was confirmed that minute crazes were present in the specimen which had been immersed in the insulating oil for 150 hours, but development or further extension of crazing did not occur. Further, in each specimen, the form changes such as swelling did not occur.

EXAMPLE 2

The procedure of Example 1 was repeated in the same manner except that the mixing ratio of the polycarbonate and the polypropylene was changed to 80% by weight: 20% by weight.

Figure 5:
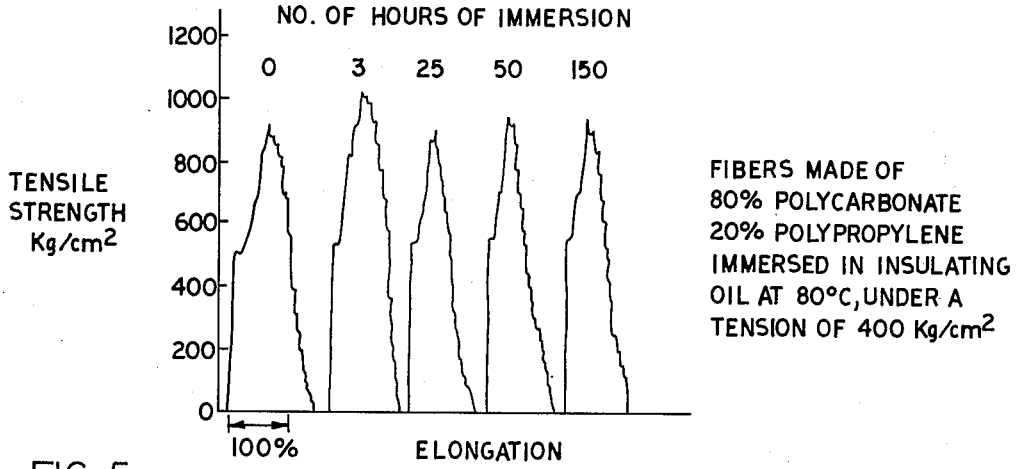
Figure 6:
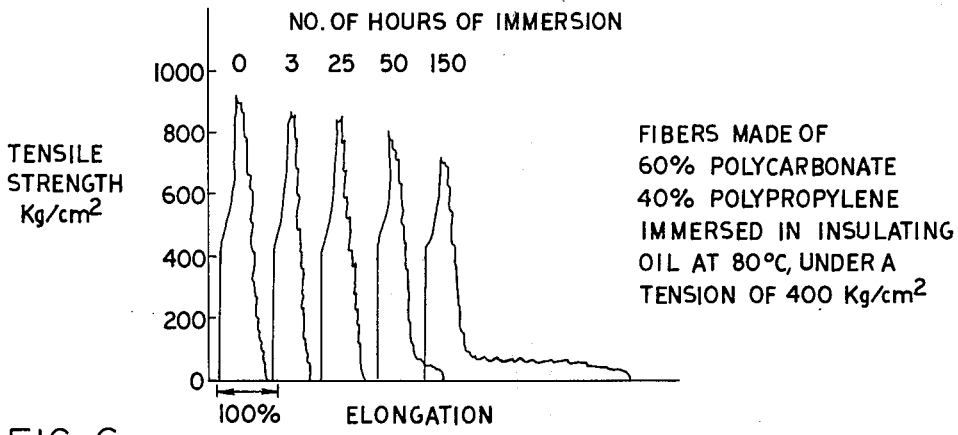

The tensile strength and elongation of the resulting fibers were determined in the same manner as in Example 1 to obtain the results shown in FIG. 5. Also in this Example, the phenomenon of the fiber becoming brittle was not observed, and from observations under an optical microscope, it was confirmed that generation of crazes did not occur. Further, no form change was observed.

EXAMPLE 3

The procedure of Example 1 was repeated in the same manner except that the mixing ratio of the polycarbonate and the polypropylene was changed to 60% by weight: 40% by weight.

The results of the measurements of the tensile strength and elongation are shown in FIG. 5. The phenomenon of the fiber becoming brittle was effectively prevented, and from observations under an optical miscroscope it was confirmed that slight formation of minute crazes occurred in the specimen which had been immersed in the insulating liquid for 150 hours. However, no development or extension of crazes was observed. In said specimen, a slight increase of the fiber diameter by swelling was observed, but it was minimal.

COMPARATIVE EXAMPLE 1

The procedure of Example 1 was repeated in the same manner except that polypropylene was not used, namely, the fibers consisted of 100% by weight of polycarbonate.

Figure 1:
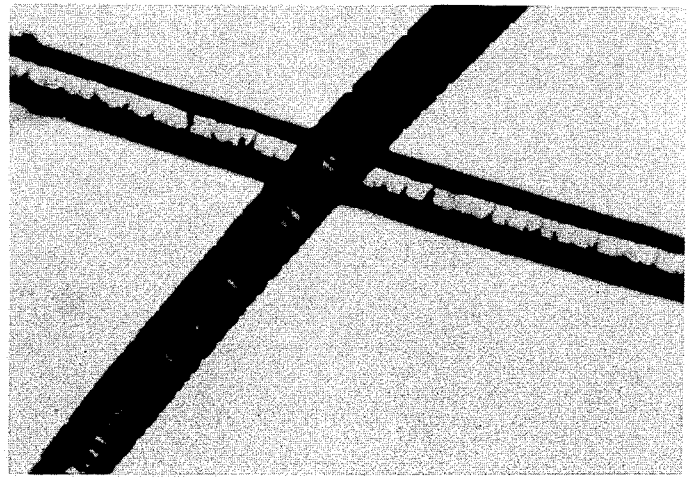
FIG. 1 is an optical microscope photograph showing the state of crazing generated in the polycarbonate fiber of Comparative Example 1.
Figure 7:
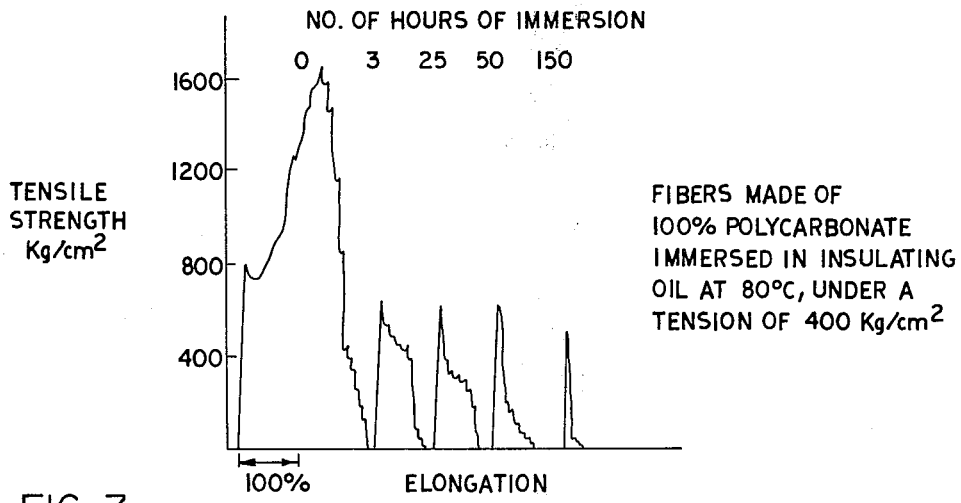

The results of the measurements of the tensile strength and elongation are shown in FIG. 7, from which it will readily be understood that the fiber was rendered drastically brittle. An optical microscope photograph of the specimen which had been immersed in the insulating oil for 25 hours is shown in FIG. 1, from which it is evident that a great number of crazes were formed.

COMPARATIVE EXAMPLE 2

The procedure of Example 1 was repeated in the same manner except that the mixing ratio of the polycarbonate and the polypropylene was changed to 25% by weight: 75% by weight.

Figure 8:
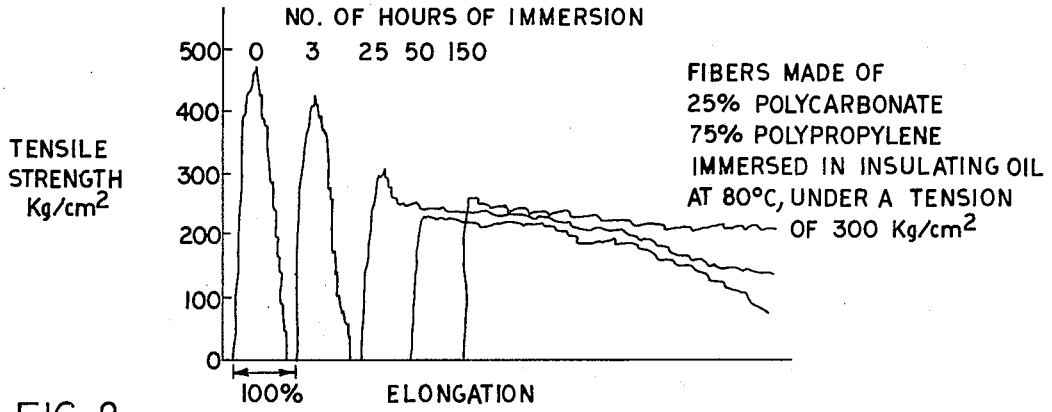

The accelerated crazing test was attempted under the same conditions as in Example 1 under a tension of 400 Kg/cm$^2$, but since the elongation of the fiber was extreme and parts of the fibers were cut, the measurement was impossible. Accordingly, the test was conducted by reducing the tension to 300 Kg/cm$^2$. The results are shown in FIG. 8. Increases of the fiber diameter and degradation of the dimension stability caused by swelling were extreme, and the fiber could not be put to practical use.

COMPARATIVE EXAMPLE 3

The procedure of Example 1 was repeated in the same manner except that polyethylene terephthalate was used instead of the polypropylene and the mixing ratio of the polycarbonate and the polyethylene terephthalate was adjusted to 75% by weight: 25% by weight. The measurement was conducted in the same manner as in Example 1.

Figure 9:
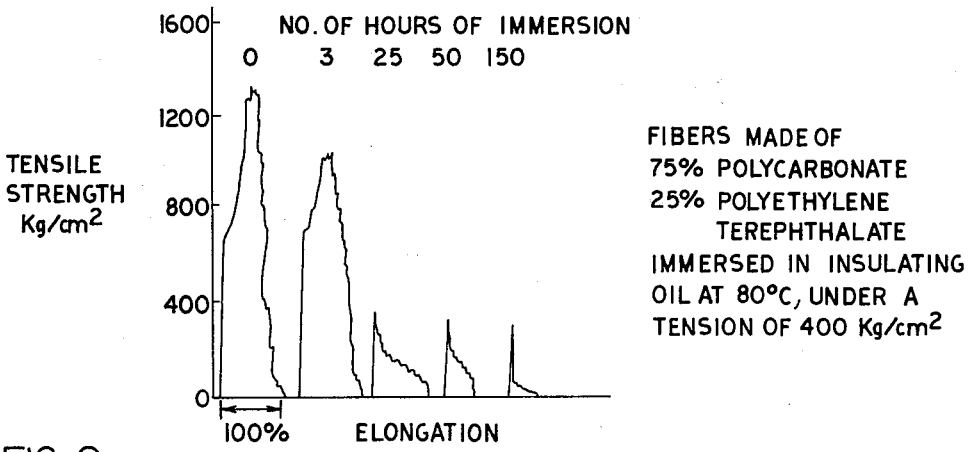

The results of the measurements of the tensile strength and elongation are shown in FIG. 9, from which it will readily be understood that the fiber was drastically brittle, like the case of the fiber composed solely of the polycarbonate. From observations under an optical microscope, it was seen that a number of developed crazes were formed in the specimen which had been immersed in the insulating oil for 25 hours. No swelling of the fiber was observed, but brittleness by formation and development of crazes was extreme. It was confirmed that no substantial effect can be obtained by incorporation of polyethylene terephthalate.

EXAMPLE 4

The multifilaments obtained in Example 2 were cut into a fiber length of 50 mm and a random web having a unit weight of 75 g/m$^2$ was prepared from the cut fibers by the air-laying method. Thus, the web was subjected to a calendaring treatment at a temperature of 150° C under a linear pressure of 100 Kg/cm.

The thus-obtained non-woven fabric had a thickness of 0.125 mm, an apparent density of 0.60 g/m$^3$ and a tensile strength of 3.6 Kg/15 mm width. This non-woven fabric could be used effectively as an electric insulating material for a power cable, a separator, a condenser or the like, because it underwent no form changes such as swelling, dissolution and crazing when immersed in an insulating oil.

EXAMPLE 5

70% by weight of poly(4,4′-dihyroxydiphenyl-2,2-propane carbonate) as the polycarbonate and 30% by weight of polypropylene were mixed in the pelletized state to form a homogeneous mixture. The mixture was fed to an extruder and was melted therein. The melt was extruded under conditions of a polymer flow rate of 5 g/min and a temperature of 280° C through 50 orifices, each having a diameter of 0.3 mm. The extrudate was wound at a takeup rate of 300 m/min and stretched at a temperature of 150° C to obtain multifilaments, each filament having a diameter of about 12 $\mu$. The thus-prepared multifilaments were cut into a length of 50 mm, and a random web having a unit weight of 80 g/m$^2$ was prepared from the cut fibers by the air-laying method. The web was lightly compressed and dipped for 15 seconds in a liquid mixture inactive at room temperature, which comprised 15% by weight of methylene chloride (boiling point = 40° C) as the solvent, and 50% by weight of methanol (boiling point = 65° C) and 35% by weight of water (boiling point = 100° C) as the non-solvent. The excess of the liquid mixture was removed by a suction devise so that the amount applied of the liquid mixture was 100% by weight based on the weight of the web. Then, the impregnated web was subjected to the calendering treatment at a temperature of 140° C under a linear pressure of 150 Kg/cm.

Methylene chloride was a good solvent for the polycarbonate and it had a slight dissolving power to the polypropylene at an elevated temperature. Methylene chloride is not miscible with water, but when methanol is incorporated, the three liquids can be homogeneously mixed.

The thus-obtained polycarbonate fiber non-woven fabric had a thickness of 0.10 mm, an apparent density of 0.80 g/cm$^3$, a tensile strength of 7.1 Kg/15 mm width, a Gurley porosity of 4,500 seconds per 100 cc and an impulse breakdown strength of 135 KV/mm. This non-woven fabric did not undergo form changes at all when immersed in an insulating oil, and it could be used very suitably for OF cables for ultra high voltages and accessory electric equipments thereof.

EXAMPLE 6

90% by weight of poly(4,4′-dihydroxydiphenylpropane carbonate) as the polycarbonate and 10% by weight of polypropylene were mixed in the pelletized state to form a homogeneous mixture. The mixture was fed to an extruder and was melted therein. The molten mixture was spun at 290° C at a polymer flow rate of 10 g/min through 240 orifices of a diameter of 0.3 mm arranged in a line, and the spun filaments were attenuated and stretched by jetting air heated at 400° C and under a pressure of 4 Kg/cm$^2$, supplied from slits disposed at positions neighboring both the sides of the linear spinning die having the line of orifices so that the diameter of the spun fiber was reduced to 6 $\mu$. The spun filaments were directly deposited and collected on a collecting screen belt to form a web having a unit weight of 100 g/m$^2$.

The web was lightly compressed at 80° C and was dipped for 20 seconds in a liquid mixture inactive at room temperature, which consisted of 20% by weight of tetrahydrofuran (boiling point = 65° C) as the solvent for the polycarbonate, and 10% by weight of ethyl alcohol (boiling point = 78° C) and 70% by weight of water (boiling point = 100° C) as the non-solvent for both the polycarbonate and polypropylene. Then, the excess of the liquid mixture was removed by a suction device so that the amount of the liquid mixture remaining in the web was 150% by weight based on the weight of the web. The web was then subjected to a calendering treatment at a temperature of 140° C under a linear pressure of 250 Kg/cm. In this Example, the ethyl alcohol was used to improve the penetration of the liquid mixture into the web.

The thus-obtained polycarbonate fiber non-woven fabric has a thickness of 0.13 mm, an apparent density of 0.77 g/cm$^3$, a tensile strength of 8.2 Kg/15 mm width, a Gurley porosity of 2,500 seconds per 100 cc and an impulse breakdown strength of 130 KV/mm. This non-woven fabric did not undergo form change when immersed in an insulating oil, and it could be used effectively as an electric insulating material for OF cables for ultra high voltages, transformers, condensers and the like.

Non-woven fabric prepared by methods as described in the foregoing Examples, which have a Gurley porosity of at least 500 seconds per 100 cc and are composed of a conjugate polycarbonate fiber comprising a polycarbonate component as the matrix and a polypropylene component dispersed and arranged substantially uniformly in the polycarbonate component matrix in the form of bundles of ultrafine fibers can be used effectively as an insulating layer of a power cable. This insulating layer is excellent in electric characteristics such as dielectric constant, dielectric loss tangent, AC breakdown strength and impulse breakdown strength, and it does not undergo breakdown by crazing or swelling or dissolution by immersion in an insulating oil and it has a very high dimensional stability.

Application of the non-woven fabric of this invention to formation of such power cable will now be described by reference to the following Examples.

EXAMPLE 7

Figure 10:
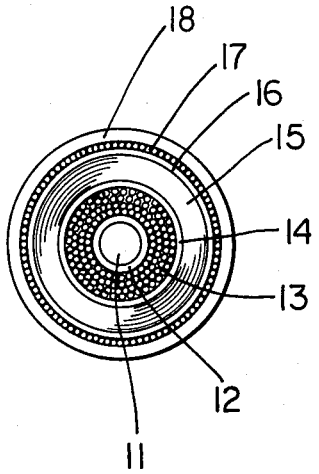
FIG. 10 is a central cross-sectional view of a power cable as obtained in Examples 7 to 9.

A specimen power cable of the type including a single hollow core as the conductor, such as shown in FIG. 10, was prepared from a non-woven fabric tape having a Gurley porosity of 600 seconds per 100 cc and com- Table 2

| Item | Unit | Example 7 | Example 8 | Model Cables Example 9 | Comparative Example 4 |
|---|---|---|---|---|---|
| Gurley porosity | sec/100 cc | 600 | 1,300 | 5,800 | 120 |
| Dielectric constant (at 80° C) | — | 2.25 | 2.27 | 2.20 | 2.25 |
| Dielectric loss tangent (at 80° C) | % | 0.044 | 0.045 | 0.043 | 0.045 |
| AC breakdown strength | KV/mm | 73 | 75 | 78 | 65 |
| Impulse breakdown strength | KV/mm | 121 | 127 | 142 | 85 |

posed of conjugate polycarbonate fibers having a fiber diameter of 6 $\mu$, comprising 90% by weight a polycarbonate component as the matrix and 10% by weight of a polypropylene component dispersed and arranged in the polycarbonate component matrix in the form of bundles of ultrafine fibers. In FIG. 10, reference numeral 11 indicates an oil passage formed by turning a stainless steel strand 12 in an open spiral form, and reference numeral 13 denotes a conductor formed by twisting together a plurality of copper or aluminum wires. Reference numerals 14, 15, 16, 17 and 18 denote an inner semiconductor layer, an insulating layer obtained by winding the above-mentioned non-woven fabric tape impregnated with an alkylbenzene type insulating oil, an outer semiconductor layer, a metal sheath and a corrosion-protective coating layer, respectively. The electric characteristics of the so obtained model cable are shown in Table 2.

EXAMPLE 8

A model cable similar to that shown in Example 7 was prepared by using a non-woven fabric tape having a Gurley porosity of 1,300 seconds per 100 cc and being composed of conjugate polycarbonate fibers having a fiber diameter of 6 $\mu$, and comprising 90% by weight of a polycarbonate component and 10% by weight of a polypropylene dispersed and arranged in the polycarbonate component matrix in the form of bundles of ultrafine fibers. The electric characteristics of the thus obtained model cable are shown in Table 2.

EXAMPLE 9

A model cable similar to that shown in Example 7 was prepared by using a non-woven fabric tape having a Gurley porosity of 5,800 seconds per 100 cc and being composed of conjugate polycarbonate fibers having a fiber diameter of 6 $\mu$, and comprising 90% by weight of a polycarbonate component as the matrix and 10% by weight of a polypropylene component dispersed and arranged in the polycarbonate component matrix in the form of bundles of ultrafine fibers. The electric characteristics of the thus-obtained model cable are shown in Table 2.

COMPARATIVE EXAMPLE 4

A model cable similar to that shown in Example 7 was prepared by using a non-woven fabric tape having a Gurley porosity of 120 seconds per 100 cc and being composed of conjugate polycarbonate fibers having a fiber diameter of 6 $\mu$, and comprising 90% by weight of a polycarbonate component as a matrix and 10% by weight of a polypropylene component dispersed and arranged in the polycarbonate component matrix in the form of bundles of ultrafine fibers. The electric characteristics of the thus obtained model cable are shown in Table 2.

As is seen from the date given in Table 2, in the case of the cable having a Gurley porosity of 120 seconds per 100 cc (Comparative Example 4), both the AC breakdown strength and the impulse breakdown strength are low, and hence, the cable is not acceptable. However, in cables having a Gurley porosity of at least 500 seconds per 100 cc (Examples 7 to 9), the above disadvantages do not occur and an especially conspicuous improvement is attained in the impulse strength. Thus, it will readily be understood that these cables can be suitably and effectively used as cables for ultra high voltages. Further, as is seen from the data of the dielectric constant and the dielectric loss tangent, these cables have a very low dielectric loss regardless of the Gurley porosity. These preferred properties of cables obtained in Examples 7 to 9 are owing to the excellent characteristics of the non-woven fabric material used.

Further, power cables of this invention shown in Examples 7 to 9 are excellent in the point that the insulating layers do not undergo swelling, dissolution or crazing breakdown in an insulating oil and have a very high form and dimensional stability.

The embodiments of the invention in which an exclusive property or privilege is claimed are defined as follows:

1. A conjugate filament consisting essentially of from 50 to 95 percent by weight of filament-forming polycarbonate and the balance is filament-forming polypropylene, said polycarbonate component forming a continuous matrix and said polypropylene component existing as a multitude of ultrafine individual fibers that are dispersed throughout the polycarbonate matrix and that extend substantially in parallel to each other for a substantial distance lengthwise of the filaments, whereby the crazing resistance and oil resistance of the filament is improved.

2. A conjugate filament as claimed in claim 1 in which the amount of said polypropylene component is from 10 to 30 percent by weight, based on the weight of the filament.

3. A fibrous sheet consisting essentially of a multitude of conjugate filaments as claimed in claim 1.

4. A compact non-woven fabric having a Gurley porosity of from 500 to 50,000 seconds per 100 cc, and consisting essentially of a multitude of filaments as claimed in claim 1.

5. An electric power cable comprising as an insulting layer thereof a non-woven fabric as claimed in claim 4.

6. A process for preparing a compact non-woven fabric as claimed in claim 4, which comprises the steps of forming a web consisting of a multitude of filaments as claimed in claim 1 having an average diameter of 0.5 to 15 $\mu$, impregnating the web with a liquid consisting of (a) from 5 to 90 percent by weight of a solvent for at least one component of the filament wherein said solvent does not dissolve or swell said component at room temperature but is effective to swell said component at elevated temperatures, and (b) the balance is a nonsolvent for both components of said filaments, is miscible with said solvent (a) and has a boiling point higher than the boiling point of said solvent (a), and pressing the impregnated web at a temperature effective to cause said solvent to dissolve or swell said component to bond said filaments to each other to form said fabric.

7. A process as claimed in claim 6 in which the unit weight of the web is within the range of from 50 to 150 $g/m^2$, and the amount of said liquid is from 10 to 500 percent by weight, based on the weight of the web.

8. A process as claimed in claim 7, in which the solvent (a) is selected from the group consisting of tetrahydrofuran, methylene chloride, tetrachloroethane, trichloroethylene, and mixtures thereof, and the nonsolvent (b) is selected from the group consisting of water, methanol, ethanol, cellosolve acetate, n-heptane and mixtures thereof.

9. A process as claimed in claim 7, in which the pressing of the impregnated web is effected by calendering at a linear calendering pressure of 30 to 300 Kg/cm, at a temperature of 120° to 160° C.

* * * * *